United States Patent [19]

Hasegawa et al.

[11] 4,296,190

[45] Oct. 20, 1981

[54] PHOTOSENSITIVE MATERIAL FOR USE IN ELECTROPHOTOGRAPHY WITH A RADIATION CURED BINDER RESIN

[75] Inventors: Haruo Hasegawa; Hiroyoshi Taniguchi; Takao Igawa, all of Tokyo, Japan

[73] Assignee: Ricoh Co., Ltd., Tokyo, Japan

[21] Appl. No.: 47,229

[22] Filed: Jun. 11, 1979

Related U.S. Application Data

[63] Continuation of Ser. No. 809,795, Jun. 24, 1977, abandoned, which is a continuation of Ser. No. 627,544, Oct. 31, 1975, abandoned.

[51] Int. Cl.[3] ..... G03G 5/04

[52] U.S. Cl. ..... 430/57; 430/96; 430/127; 430/130

[58] Field of Search ..... 430/94, 96, 124, 57, 430/127, 130; 204/159.19, 159.13

[56] References Cited

U.S. PATENT DOCUMENTS

| | | | |
|---|---|---|---|
| 3,060,024 | 10/1962 | Burg et al. | 430/254 |
| 3,291,600 | 12/1966 | Nicoll | 430/130 X |
| 3,508,961 | 4/1970 | Makino et al. | 430/130 |
| 3,687,659 | 8/1972 | Komiya et al. | 430/94 X |

*Primary Examiner*—Richard L. Schilling
*Assistant Examiner*—John L. Goodrow
*Attorney, Agent, or Firm*—Blanchard, Flynn, Thiel, Boutell & Tanis

[57] ABSTRACT

The present invention provides a photosensitive material for use in electrophotography which is superior in durability, resistance to solvents and light sensitivity, which comprises a photoconductive layer consisting essentially of an inorganic or organic photoconductor and an ionizing radiation-curable resin as formed on a conductive support, said photoconductive layer having been cured by applying said radiation.

14 Claims, No Drawings

PHOTOSENSITIVE MATERIAL FOR USE IN ELECTROPHOTOGRAPHY WITH A RADIATION CURED BINDER RESIN

This is a continuation of application Ser. No. 809,795, filed June 24, 1977 now abandoned, which in turn is a continuation of application Ser. No. 627,544, filed Oct. 31, 1975, now abandoned.

BACKGROUND OF THE INVENTION (a) Field of the Invention

The present invention relates to an improved photosensitive material for use in electrophotography which is prepared by forming an inorganic or organic photoconductive layer on a conductive support.

(b) Description of the Prior Art

Generally known electrophotographic sensitive materials are prepared by forming, by a coating process, a photoconductive layer comprising a dispersion obtained by dispersing an inorganic or organic photoconductor such as zinc oxide, titanium oxide, anthracene, carbazole, etc. in a resin. In order to form an image on such a photosensitive material, there is usually employed the method of repeating the five steps of charging the photoconductive layer with electricity, exposing, developing with a dry or wet developer, transferring the developed image to a plain paper, and cleaning off the developer left on the photoconductive layer. However, repeated use of such a photosensitive material has been attended with such drawbacks as gradual abrasion, breakdown or exfoliation of the photoconductive layer surface. Increase of the ratio of the resin content in the photoconductive layer is admittedly effective for overcoming such drawbacks, but as it entails deterioration of the light sensitivity, it has been inevitable to compromise on a fixed mixing ratio, and accordingly, it has been difficult to obtain a photosensitive material that will meet both requirements of light sensitivity and durability simultaneously. Besides, there are frequent occasions when it becomes necessary to apply heat for the purpose of drying or curing the photoconductive layer at the time of preparing photosensitive materials. In such a case, because there is a fear of causing thermal degradation of the photoconductive layer and/or the support, it has been impossible to apply a sufficient heating, entailing frequent deterioration of the strength of the photoconductive layer. Further, in the case of developing with a wet-developer, the photoconductive layer surface is required to have resistance to the solvent, but inasmuch as photosensitive materials of this kind have been poor in resistance to solvents, they have been defective in that they show a remarkable deterioration of properties at the time of wet development.

Meanwhile, as an attempt to improve mainly the sensitivity of a photosensitive material comprising a single photoconductive layer as above, there is known a photosensitive material sensitized by lamination or prepared by forming two kinds of photoconductive layers different in properties one upon the other and disposed on a support, such as, one prepared by forming a layer of an inorganic or organic photoconductor resin dispersion and a layer of an organic photoconductor, in that order, on a support or one prepared by forming said two layers by reversing that order on a support. However, in the case of the photosensitive material wherein the layer of the dispersion constitutes the uppermost layer, it has been inferior in durability such as resistance to abrasion and solvents like in the case of the aforesaid single-layer type photosensitive material, while in the case of the photosensitive material wherein the layer of organic photoconductor constitutes the uppermost layer, it also has been insufficient in durability because of the insufficient physical strength of the layer of the dispersion constituting the lower layer.

SUMMARY OF THE INVENTION

The object of the present invention is therefore to provide an electrophotographic sensitive material which meets both requirements of sensitivity and durability simultaneously and is superior in its resistance to solvents.

This object can be accomplished by the provision of an electrophotographic sensitive material comprising a photoconductive layer consisting essentially of an inorganic or organic photoconductor and an ionizing radiation-curable resin formed on a conductive support and wherein that resin is cured by applying ionizing radiation.

The photosensitive material according to the present invention can be classified into the following three types by the number of photoconductive layers (one layer or two); but it is not limited to these three types, and what is essential is to have a photoconductive layer cured by applying ionizing radiation.

(1) A photosensitive material prepared by forming a dispersion type photoconductive layer on a conductive support, said layer comprising an inorganic or organic photoconductor and an ionizing radiation-curable resin.

(2) A photosensitive material prepared by forming a dispersion type photoconductive layer, as aforesaid and an organic photoconductor type photoconductive layer, in that order, on a conductive support.

(3) A photosensitive material prepared by forming an organic photoconductor type photoconductive layer and a dispersion type photoconductive layer as aforesaid, in that order, on a conductive support.

In order to prepare such photosensitive materials, for the photosensitive materal of the type (1) above, it will do to form a photoconductive layer (said layer corresponds to the first photoconductive layer of types (2) & (3) stated hereinafter) by coating a solution or dispersion consisting essentially of an inorganic or organic photoconductor and an ionizing radiation-curable resin on a conductive support and thereafter curing said photoconductive layer by applying ionizing radiation thereto; for the photosensitive material of the type (2) above, it will do to form a photoconductive layer cured in the same way as in the case of the photosensitive material of the type (1) above (hereinafter called the first photoconductive layer) on a conductive support and thereafter form the other photoconductive layer (hereinafter called the second photoconductive layer) on the first photoconductive layer by coating a solution or dispersion consisting essentially of an organic photoconductor; and for the photosensitive material of the type (3) above, it will do to form the second photoconductive layer on a conductive support in the same way as in the case of the photosensitive material of the type under (2) above and thereafter form the first photoconductive layer on said second photoconductive layer in the same way as in the case of the photosensitive material of the type (1) above.

In the present invention, as the conductive support, such conductive materials as aluminum, iron, nickel, tin, copper, zinc, brass, stainless steel, tin oxide and indium oxide as well as sheet-shaped, plate-shaped or cylinder-shaped materials consisting of a composite of these conductive materials and paper or plastics are applicable.

To give examples of the photoconductor for use in the first photoconductive layer, there are zinc sulfide, zinc oxide, zinc arsenide, cadmium sulfide, arsenic sulfide, lead monoxide, gallium selenide, indium sulfide, cadmium selenide, arsenic selenide, non-crystalline selenium powder, mercuric oxide, titanium dioxide, zinc titanate, sulfur, anthracene, pyrene, perylene, benzthiazole, imidazole, benzimidazole, bisbenzimidazole, trinitrofluorenone, pyrazoline derivatives, phthalocyanine derivatives, carbazole, polyvinyl carbazole, polyacenaphthylene, polyvinyl anthracene, polyvinyl pyrene, polyvinyl bromopyrene, polyvinyl acetophenone, poly[1,5-diphenyl-3-(paravinyl phenyl) pyrazoline], etc., but the applicable photoconductor is not limited to these substances.

As the ionizing radiation-curable resin for use in the present invention, unsaturated polymer resin containing ethylenic double bonds and acrylic resin having double bond are principal ones. And, to give concrete examples, there are non-modified maleic anhydride type unsaturated polyester; silicone-modified, urethane-modified or acylic urethane-modified maleic anhydride type unsaturated polyester; polyester having maleyl group; acrylic polymer having maleyl group; epoxide resin having maleyl group; acrylic polymer having acryloyl group $$\left(\begin{array}{c} H \\ | \\ CH_2{=}C{-}COO{-} \end{array}\right. \quad \text{or} \quad \left.\begin{array}{c} CH_3 \\ | \\ CH_2{=}C{-}COO{-} \end{array}\right)$$

in the side chain thereof; telomerized polyester acrylate; telomerized polyamide acrylate; epoxyacrylate; urethane acrylate; silicone acrylate; and allyl group reactive type resins such as polymers with pendent allyl groups obtained by allylglycidyl-ether-modification of allylglycidyl ether copolymers, and diallylphthalate resins, etc.

These ionizing radiation-curable resins are normally applied by dissolving same in a polymerizable monomer such as styrene, methyl methacrylate, ethyl methacrylate, butyl methacrylate, dimethylaminoethyl methacrylate, tetrahydrofurfuryl methacrylate, butyl acrylate, 2-ethylhexyl acrylate, N-vinyl pyrrolidone, etc. In this connection, these monomers are supposed to give rise to reaction along with said ionizing radiation-curable resin afterwards and participate in the curing of the first photoconductive layer.

The appropriate amount of the ionizing radiation curable resin to be applied is in the range of from 0.2 to 50 parts by weight per 100 parts by weight of photoconductor employed; in the case where it is less than 0.2 part by weight, the physical strength of the resulting photoconductive layer will become insufficient, while in the case where it exceeds 50 parts by weight, the sensitivity of same will become inferior.

Applicable ionizing radiation include accelerated electron beam, neutron, $\alpha$-rays, $\beta$-rays, $\gamma$-rays, X-rays, proton, deuteron, etc., but accelerated electron beam is most prevalently employed.

As the component of the first photoconductive layer, in addition to the foregoing substances, spectrum sensitizers such as Rhodamine B, Crystal Violet, Methylene Blue, Erythrosine and copper phthalocyanine, chemical sensitizers such as 2-methyl anthraquinone, tetracyanoethylene, tetracyanoquinodimethane, picric acid, chloranil, 2,4,7-trinitro-9-fluorenone and 3,5-dinitrobenzoic acid and other additives can be added in an appropriate amount as occasion demands.

As the organic photoconductor to be employed for the second photoconductive layer, any of the afore mentioned organic photoconductors is applicable.

To the second photoconductive layer can be added some conventional resinous binder such as polyester, epoxide resin and polycarbonate and solvent (as additive) such as tetrahydrofuran.

To speak of the appropriate thickness of the photoconductive layer, the results of tests are as follows:

As to the thickness of the first photoconductive layer, in the case where the photoconductive layer is of single-stratum, it is appropriate to be in the range of from 3 to 80$\mu$, while in the case where it is of double-stratum, it is appropriate to be in the range of from 0.1 to 10$\mu$ preferably in the range of from 0.5 to 3$\mu$. And, as to the thickness of the second photoconductive layer (only in the case where the photoconductive layer is of double-stratum) it is appropriate to be in the range of from 3 to 50$\mu$—preferably in the range of from 6 to 20$\mu$.

Further, on the occasion of forming the first photoconductive layer or the second photoconductive layer, a well-known method such as dip-coating method and roll-coating method is adopted, and after thus coating, surplus of the low boiling-point solvent is removed under reduced pressure as occasion demands.

The description of the present invention hereinabove centers on the improvement of the physical strength and so forth of the photoconductive layer by employing an ionizing-radiation-curable resin as the resinous binder for photoconductive layer and curing said resin. However, in the case of preparing an electrophotographic sensitive material having a stratum composition consisting of, for instance, support, adhesive layer and photoconductive layer, or, support, photoconductive layer and protective layer, the intended object of the present invention could be accomplished as well by providing an electrophotographic sensitive material prepared by the use of an ionizing radiation-curable resin as the resin for use in forming the adhesive layer or protective layer and by curing it through the same process as above.

DESCRIPTION OF THE PREFERRED EMBODIMENTS

EXAMPLE 1

A mixture prepared by mixing epoxide resin having molecular weight in the range of from 900 to 1000 and an epoxide equivalent in the range of from 480 to 550 (namely, a manufacture of DAINIPPON INK KAGAKU KOGYO K.K. sold under the name of Epiclon) with fumaric acid at the rate of 15 g of the latter to 100 g of the former was stocked in a four-necked flask with thermometer, stirrer, nitrogen supply pipe and cooling pipe and then dioxane was added as solvent for reaction to said mixture to thereby adjust the concentration of resin to be 50%. Next, after adding 0.3 g of triethylamine as catalyst for reaction, reaction was continuously effected for about 15 hours by utilizing the reflux temperature of dioxane while introducing nitrogen gas into the mixture. The progress of reaction was followed up by observing the acid value and epoxide value, and when the acid value became less than 10.5, the reaction was discontinued. After finishing the reaction, dioxane in the system of the reaction was removed by vacuum distillation.

After preparing a solution by adding 60 g of N-vinyl pyrrolidone to 40 g of the thus obtained ionizing radiation-curable resin consisting of epoxide resin ester, by adding 100 g of cadmium sulfide particles and 0.3 g of a wax-like high-molecular castor oil derivative manufactured by Bakers M.P.A, U.S.A., thereto dispersing therein by means of a sandmill, a coating material was obtained. Then, by applying this coating material onto a cylindrical aluminum support, 120 mm in diameter, 300 mm in length and 4 mm in thickness, by the dipping method, a 50μ-thick first photoconductive layer was formed. Subsequently, while turning the cylindrical support at a velocity of 6 rpm, electron beam was applied to said photoconductive layer under the following conditions.

| | |
|---|---|
| voltage | 300 KV |
| electric current | 5 mA |
| distance between the source of radiation and object to be irradiated | 25 cm |
| total amount of radiation | 15 M rad |
| atmosphere | nitrogen |

The resultant electrophotographic sensitive material manifested satisfactory electrostatic properties such that the saturated electric potential Vs charged by corona discharge in the dark was −1080 V and the amount of exposure by means of tungsten lamp required for half-decay E ½ was 6.5 lux.sec. And, the first photoconductive layer had been cured enough to be invulnerable to such solvents as acetone, kerosene, etc. When this photosensitive material was employed for copying by the use of a commercial plain-paper copying machine according to the image-transferring method employing wet-developer (a copying machine equipped with mechanisms for charging of the photosensitive material, image-wise exposure, development of the image, transfer of the image to a plain paper, cleaning of the developer left on the photosensitive material and elimination of charge from the photosensitive material), it displayed a durability sufficient for producing more than 10,000 copies while maintaining a satisfactory copied image.

In this connection, the use of castor oil in the present example was for the purpose of facilitating dispersion of cadmium sulfide.

EXAMPLE 2

After preparing a resin by making 8 moles of fumaric acid, 2 moles of tetrahydrophthalic anhydride, 8 moles of ethylene glycol and 3.5 moles of diethylene glycol react in the atmosphere of nitrogen gas at a temperature of 200° C., adding 1 mole of fatty acid from linseed oil at the time when condensation water equivalent to about 78% of the theoretical condensation water (inclusive of the condensation water from fatty acid) had been distilled off, and further continuing the reaction at a temperature of 200° C. to effect condensation until the viscosity of resin became about 28 poise (as measured at 25° C. upon preparing a cellulose acetate solution having 60% of resin content by way of sampling), said resin was diluted with styrene so as to make the resin content 75%. Next, after adding 5 g of toluene diisocyanate to 134 g of the resulting solution, effecting reaction at a temperature of 50° C. for 2 hours, and then adding 5 g of β-hydroxyethyl methacrylate, reaction was finished.

Subsequently, after preparing a solution by adding 40 g of styrene and 25 g of β-hydroxyethyl methacrylate to 30 g of the resultant ionizing radiation-curable resin consisting of urethanized-fatty-acid modified unsaturated polyester resin, a coating material was prepared by adding 80 g of cadmium sulfide particles and 20 g of titanium oxide particles to said solution and dispersing therein by means of a ball-mill. Then, by applying this coating material onto a cylindrical aluminum support, 130 mm in diameter, 300 mm in length and 5 mm in thickness, by the blade method, a 60μ-thick first photoconductive layer was formed. Thereafter, while turning the cylindrical support at a velocity of 6 rpm, electron beam was applied to said photoconductive layer under the following conditions.

| | |
|---|---|
| voltage | 300 KV |
| electric current | 25 mA |
| distance between the source of radiation and the object to be irradiated | 25 cm |
| total amount of radiation | 10 M rad |
| atmosphere | air |

When measured by the same method as in Example 1, the electrophotographic sensitive material prepared through the foregoing process manifested satisfactory electrostatic properties such that the saturated electric potential Vs charged was −1150 V and the amount of exposure by means of tungsten lamp required for half-decay E ½ was 4.0 lux.sec. And, the first photoconductive layer had been cured enough to be invulnerable to such solvents as acetone, kerosene, etc. When this photosensitive material was employed for copying by the use of a plain-paper copying machine according to the image-transferring method employing dry-developer, it displayed a durability sufficient for producing more than 10,000 copies while maintaining a satisfactory copied image.

EXAMPLE 3

200 g of isophthalic acid, 88 g of adipic acid, 84 g of neopentyl glycol and 164 g of trimethylol propane were stocked in a flask equipped with thermometer, water separator provided with rectifier, nitrogen gas supply pipe, stirrer, etc. and were heated at a temperature of 140° C. in the atmosphere of nitrogen gas. Next, the temperature was raised from 160° to 220° C. in about 2 hours. When heating at a temperature of 220° C. was continued for 1 hour and the reaction system became transparent, 112 g of fatty acid from linseed oil and 0.056 g of hydroquinone as polymerization inhibitor were added thereto and reaction was further effected for 2 hours at a temperature of 200° C. Subsequently, 25 g of toluene were added to the reaction system to switch the reaction method from the fusion method to the solvent method, and reaction was continuously effected while conducting dehydration until the acid value became 14 and the viscosity became about 1.2 poise (as measured at 25° C. upon preparing a cellulose acetate solution having 50% of resin content by way of sampling).

To a solution prepared by adding 50 g of methyl methacrylate to 25 g of the resultant ionizing radiation-curable resin consisting of fatty-acid-modified saturated polymer resin was added 0.3 g of toluene solution (metallic content: 12%) of cobalt naphthenate as metallic salt desiccating agent, and after thorough mixing, by adding 80 g of tetrahydrofuran, followed by 70 g of anthracene particles and 30 g of 3,5-nitrobenzoic acid as sensitizer, and thoroughly dispersing them by means of a ball-mill, a coating material was prepared. By applying this coating material by the roll method onto a support prepared by depositing aluminum through vacuum evaporation on both sides of a 80μ-thick polyester film and drying it by hot air having a temperature of 60° C., the first photoconductive layer having a thickness of 12μ as measured after evaporating mainly tetrahydrofuran was formed. This first photoconductive layer formed on the support was irradiated with electron beam under the following conditions.

| | |
|---|---|
| voltage | 300 KV |
| electric current | 23 mA |
| distance between the source of radiation and the object to be irradiated | 8 cm |
| total amount of radiation | 12 M rad |
| atmosphere | air |

The first photoconductive layer of the resultant electrophotographic sensitive material proved to have an improved resistance to solvent enough to be invulnerable to such solvents as acetone, kerosene, etc. and superior in physical strength such as frictional resistance, bending strength, etc. When this electrophotographic sensitive material was electrified by corona discharge of +6 KV, subjected to 10 seconds' exposure to a 500 W halogen lamp disposed 20 cm above it through a superposed transparent original and developed with a dry-developer, there was obtained a distinct image.

EXAMPLE 4

After stocking 480 g of dimethyl triphenyl trimethoxy trisiloxane obtained by methoxizing the partial hydrolisis product of monophenyl silane and phenylmethyl silane (Dow.Corning.Silkyd 50, the manufacture of Dow-Corning Co., USA) and 600 g of neopentyl glycol in a reactor, the content was heated at a temperature of 174° C., whereby about 98 g of methanol were distilled out through the top of reactor. Then, after cooling the content down to a temperature of about 120° C., 88 g of maleic anhydride, 440 g of tetrahydrophthalic anhydride, 1 g of dibutyl tin oxide and 68 g of xylene were added thereto. The temperature of the contents rose gradually and became about 220° C. This temperature was maintained until the acid value of the resulting resin became about 10. Next, after removing xylene from the contents under reduced pressure, 28 g of hydroquinone were added thereto, and the whole mixture was cooled down to a temperature of about 93° C. Upon preparing a solution by adding 40 g of styrene and 40 g of methyl methacrylate to 25 g of the resultant ionizing radiation-curable resin consisting of silicone modified maleic anhydride type unsaturated polyester resin, by adding thereto 80 g of cadmium sulfide particles, 20 g of cadmium selenide particles and 0.2 g of a wax-like high-molecular castor oil derivative as dispersion assistant and dispersing them by means of a supersonic disperser, a coating material was prepared. By applying this coating material onto a 2 mm-thick flat boardshaped aluminum support by the roll method, a 50μ-thick first photoconductive layer was formed. This first photoconductive layer formed on the support was irradiated with electron beam under the following conditions.

| | |
|---|---|
| voltage | 300 KV |
| electric current | 2 mA |
| distance between the source of radiation and the object to be irradiated | 25 cm |
| total amount of radiation | 15 M rad |
| atmosphere | nitrogen |

When measured by the same method as in Example 1, the electrophotographic sensitive material prepared through the foregoing process manifested superior electrostatic properties such that the saturated electric potential Vs charged was −970 V and the amount of exposure by means of tungsten lamp required for half-decay E ½ was 3.0 lux.sec. And, the first photoconductive layer had been cured enough to be invulnerable to such solvents as acetone, kerosene, etc. and superior in physical strength such as resistance to abrasion, hardness, resistance to exfoliation, etc.

EXAMPLE 5.

After adding 2 g of styrene and 6 g of methyl methacrylate to 20 g of the same ionizing radiation-curable resin as used in Example 4 and dissolving the resulting mixture in 400 g of tetrahydrofuran, by adding 45 g of polyvinyl carbazole and 55 g of 2,4,7-trinitro-9-fluorenone and thoroughly stirring by means of a mixer, a coating material was prepared. By applying this coating material onto a conductive support consisting of aluminum plate and evaporating off tetrahydrofuran under reduced pressure, the first photoconductive layer of about 12μ thick was formed. This first photoconductive layer formed on the support was irradiated with electron beam under the following conditions.

| | |
|---|---|
| voltage | 280 KV |
| electric current | 10 mA |
| distance between the source of radiation and the object to be irradiated | 25 cm |
| total amount of radiation | 15 M rad |
| atmosphere | nitrogen |

The electrophotographic sensitive material prepared through the foregoing process manifested satisfactory electrostatic properties such that the saturated electric potential Vs charged by corona discharge in the dark was −920 V and the amount of exposure by means of tungsten lamp required for half-decay E ½ was 7 lux.sec. And, the first photoconductive layer had been cured enough to be invulnerable to such solvents as tetrahydrofuran, kerosene, etc. When this photosensitive material was employed for copying by the use of a plain-paper copying machine according to the image-transferring method employing wet-developer, it displayed a durability sufficient for producing more than 10,000 copies.

EXAMPLE 6

100 g of toluene was heated up to 80° C. while stirring within a current of nitrogen gas. While maintaining this temperature, 0.5 g of azo-bis-isobutyronitrile was added, and then a mixture of 10 g of glycidyl methacrylate and 90 g of methyl methacrylate was added by dropping over 2 hours' period. Then, after further adding 0.5 g of azo-bis-isobutyronitrile, the resulting mixture was copolymerized by maintaining the temperature thereof in the range of from 80° to 90° C. for 5 hours while stirring, whereby a copolymer of glycidyl methacrylate and methyl methacrylate having epoxide value of 6.60 was obtained. When this copolymer was further maintained at a temperature in the range of from 80° to 90° C. and made to react by adding 6 g of propiolic acid (CH≡C COOH) thereto, there was produced a copolymer of glycidyl methacrylate and methyl methacrylate with propiolic acid having epoxide value of 1.45 added thereto.

After dissolving 20 g of the ionizing radiation-curable resin prepared as above in 100 g of methyl methacrylate and adding thereto a solution prepared by dissolving 43 g of vinyl carbazole chloride and 57 g of 2,4,7-trinitro-9-fluorenone in 400 g of tetrahydrofuran, followed by thorough stirring by means of a mixer, a coating material was prepared. By applying this coating material onto a conductive support consisting of aluminum plate and evaporating off tetrahydrofuran under reduced pressure, an about 14μ-thick first photoconductive layer was formed. This first photoconductive layer formed on the support was irradiated with electron beam under the same conditions as in Example 4.

The electrophotographic sensitive material prepared through the foregoing process manifested very satisfactory electrostatic properties such that the saturated electric potential Vs charged by corona discharge in the dark was −980 V and the amount of exposure by means of tungsten lamp required for half-decay E ½ was 5.5 lux.sec. And, the first photoconductive layer had been cured enough to be invulnerable to such solvents as tetrahydrofuran, kerosene, etc. When this photosensitive material was employed for copying by the use of the same copying machine as used in Example 4, it displayed a durability sufficient for producing more than 10,000 copies.

EXAMPLE 7

Upon stocking 40 g of ethyl acrylate, 23 g of methyl methacrylate, 38 g of allyl glycidyl ether and 1.0 g of benzoyl peroxide in a reactor, 95 g of hot xylene were gradually added over 4 hours' period by the use of a dropping funnel while stirring the contents of the reactor and maintaining the temperature thereof in the range of from 100° to 120° C. After completion of the dropping, the reactants were further maintained at this temperature for 1 to 2 hours and then cooled down to room temperature. 70 g of the copolymer thus obtained was put in another reactor, a solution consisting of 30 g of allyl alcohol and 0.2 g of potassium hydroxide was added thereto while stirring at room temperature, and then the resulting mixture was heated up to a temperature in the range of from 100° to 120° C. After maintaining this temperature for 7 hours, the mixture was cooled. Next, this reaction mixture was heated up to about 60° C., and xylene and the excess reactants were removed by vacuum distillation.

After dissolving 30 g of the thus obtained ionizing radiation-curable resin in 60 g of styrene, by adding a solution prepared by dissolving 100 g of polyvinyl carbazole bromide and 0.2 g of Crystal Violet in 800 g of tetrahydrofuran and thoroughly stirring by means of a mixer, a coating material was prepared. By applying this coating material onto a conductive support consisting of polyester film deposited with aluminum through vacuum evaporation, and then evaporating off tetrahydrofuran under reduced pressure, the first photoconductive layer of about 10μ thick was formed. This photoconductive layer was irradiated with electron beam under the following conditions.

| | |
|---|---|
| voltage | 270 KV |
| electric current | 20 mA |
| distance between the source of radiation and the object to be irradiated | 20 cm |
| total amount of radiation | 10 M rad |
| atmosphere | nitrogen |

The electrophotographic sensitive material prepared through the foregoing process possessed satisfactory electrophotographic properties and desirable physical strength, and displayed superior resistance to solvents.

EXAMPLE 8

After preparing a solution by adding 60 g of N-vinyl pyrrolidone to 40 g of the same ionizing radiation-curable resin consisting of epoxide resin ester as employed in Example 1, by adding thereto 100 g of cadmium arsenide and 0.3 g of a wax-like high-molecular castor oil derivative and dispersing them by means of a sand-mill, a coating material was prepared. By applying this coating material onto a 4 mm-thick plate-shaped aluminum support by the spray method, a 2μ-thick first photoconductive layer was formed. This first photoconductive layer formed on the support was irradiated with electron beam under the following conditions.

| | |
|---|---|
| voltage | 300 KV |
| electric current | 5 mA |
| distance between the source of radiation and the object to be irradiated | 25 cm |
| total amount of radiation | 8 M rad |
| atmosphere | nitrogen |

By applying a coating material consisting of 100 g of poly[1,5-diphenyl-3-(paravinyl phenyl)-pyrazolin], 10 g of polyester adhesive and 2000 g of tetrahydrofuran onto the thus cured first photoconductive layer by the dipping method and drying thereafter, a 12μ-thick second photoconductive layer was formed.

On this occasion, the first photoconductive layer proved quite free from getting impaired by tetrahydrofuran, and the resultant photosensitive material manifested satisfactory electrostatic properties such that the saturated electric potential Vs charged by corona discharge in the dark was +1150 V and the amount of exposure by means of tungsten lamp required for half-decay E ½ was 9.2 lux.sec.

Meanwhile, in the case of an electrophotographic sensitive material prepared for the purpose of comparison by the use of conventional epoxide ester resin (Beckosol P-786, the manufacture of DAINIPPON INK KAGAKU KOGYO K.K. ) in lieu of the ionizing radiation-curable resin used in the present example and under the same conditions as that in the present example save for effecting the curing by 30 minutes' heat treatment at a temperature of 150° C., Vs was 1080 V and E ½ was 420 lux.sec, that is, the light sensitivity was much inferior.

EXAMPLE 9

After preparing a solution by adding 40 g of styrene and 25 g of β-hydroxyethyl methacrylate to 30 g of the same ionizing radiation-curable resin consisting of urethanized-fatty-acid modified unsaturated polyester resin as employed in Example 2, by adding thereto 100 g of non-crystalline selenium powder and dispersing therein by means of a ball-mill, a coating material was prepared. By applying this coating material onto a cylindrical aluminum support, 130 mm in diameter, 300 mm in length and 5 mm in thickness, by the blade method, a 1.5μ-thick first photoconductive layer was formed. Subsequently, while turning the cylindrical support at a velocity of 6 rpm, electron beam was applied to said first photoconductive layer under the following conditions.

| | |
|---|---|
| voltage | 300 KV |
| electric current | 25 mA |
| distance between the source of radiation and the object to be irradiated | 25 cm |
| total amount of radiation | 8 M rad |
| atmosphere | air |

By applying a coating material consisting of 100 g of poly-N-vinyl carbazole, 10 g of polyester adhesive and 1,000 g of tetrahydrofuran onto the thus cured first photoconductive layer by the spray method, followed by vacuum drying, a 10μ-thick second photoconductive layer was formed.

When measured by the same method as in Example 8, the photosensitive material prepared through the foregoing process manifested satisfactory electrostatic properties such that Vs was −1030 V and E ½ was lux.sec. And, when employed for copying by the use of a plain-paper copying machine according to the image-transferring method employing dry-developer, it displayed a durability sufficient for producing more than 10,000 copies while maintaining a satisfactory copied image having the background free of any stains.

EXAMPLE 10

After preparing a solution by adding 50 g of methyl methacrylate to 25 g of the same ionizing radiation-curable resin consisting of fatty acid modified saturated polyester resin as employed in Example 3, by adding thereto 0.3 g of a toluene solution of cobalt naphthenate (metallic content: 12%) and thoroughly mixing, adding 80 g of tetrahydrofuran thereafter, and then adding 50 g of copper phthalocyanine (Cyanine Blue-BNGS, the manufacture of TOYO INK SEIZO K.K.) and thoroughly dispersing by means of a ball-mill, a coating material was prepared. By applying this coating material by the roll method onto a support prepared by depositing aluminum through vacuum evaporation on both sides of an 80μ-thick polyester film and drying by a hot air having a temperature of 60° C., the first photoconductive layer having a thickness of 1.5μ after evaporating off mainly tetrahydrofuran was formed. This first photoconductive layer formed on the support was irradiated with electron beam under the following conditions.

| | |
|---|---|
| voltage | 30 KV |
| electric current | 25 mA |

-continued

| | |
|---|---|
| distance between the source of radiation and the object to be irradiated | 8 cm |
| total amount of radiation | 7 M rad |
| atmosphere | air |

By applying a coating material consisting of 100 g of poly-N-vinyl carbazole, 18 g of polycarbonate and 1,000 g of monochlorobenzene by the roll method onto the thus cured first photoconductive layer and drying thereafter, a 13μ-thick second photoconductive layer was formed. The resultant electrophotographic sensitive material was superior in physical strength, e.g., frictional resistance, bending strength, etc., and manifested satisfactory electrostatic properties such that Vs was −1220 V and E ½ was 21 lux.sec. When this photosensitive material was electrified by corona discharge of −6 KV, subjected to 1 second's exposure by means of a 500 W halogen lamp disposed 20 cm above it through a superposed transparent original and then developed with a dry-developer, there was obtained a distinct image.

EXAMPLE 11

After preparing a solution by adding 40 g of styrene and 40 g of methyl methacrylate to 25 g of the same ionizing radiation-curable resin consisting of silicone modified maleic anhydride type unsaturated polyester resin as that employed in Example 4, by adding thereto 80 g of cadmium sulfide particles, 20 g of cadmium selenide and 0.2 g of wax-like high-molecular castor oil derivative as dispersion assistant and dispersing by means of a supersonic disperser, a coating material for use in forming the first photoconductive layer was prepared. On the other hand, by applying a coating material consisting of 100 g of 1,3,5-triphenyl pyrazoline, 15 g of polycarbonate and 1,000 g of benzene onto a 2 mm-thick flat board-shaped aluminum support by the blade method and drying by a hot wind thereafter, a 15μ-thick second photoconductive layer was formed.

By applying the aforesaid coating material for forming the first photoconductive layer onto this second photoconductive layer by the blade method, a 3μ-thick first photoconductive layer was formed.

The thus formed first photoconductive layer was irradiated with electron beam under the following conditions.

| | |
|---|---|
| voltage | 300 KV |
| electric current | 2 mA |
| distance between the source of radiation and the object to be irradiated | 25 cm |
| total amount of radiation | 12 M rad |
| atmosphere | nitrogen |

When measured by the same method as in Example 8, the photosensitive material prepared through the foregoing process manifested superior electrostatic properties such that Vs was −1170 V and E ½ was 9.0 lux.sec. And, the first photoconductive layer of this photosensitive material had been cured enough to be invulnerable to such solvents as acetone, kerosene, etc., and the physical strength thereof, e.g., resistance to abrasion, hardness, resistance to exfoliation, etc., was also satisfactory.

For the purpose of comparing with the present example, a photosensitive material was prepared by employing a conventional polyester resin (Polyester Adhesive 49000, the manufacture of Du Pont Co., USA) in lieu of the ionizing radiation-curable resin employed in the present example at the time of forming the first photoconductive layer. This comparative photosensitive material was found to be inferior in resistance to solvents as well as resistance to abrasion and non-durable in repeated use.

EXAMPLE 12

By applying a coating material consisting of 100 g of Poly-N-vinyl carbazole, 18 g of polycarbonate and 700 g of monochlorobenzene onto a cylindrical aluminum support, 130 mm in diameter, 300 mm in length and 5 mm in thickness, by the blade method and drying by a hot air thereafter, an 8μ-thick second photoconductive layer was formed.

On the other hand, after preparing a solution by adding 40 g of styrene and 25 g of β-hydroxyethyl methacrylate to 30 g of an ionizing radiation-curable resin consisting of urethanized-fatty-acid modified unsaturated polyester resin obtained in the same way as in Example 2, by adding thereto 30 g of X-type metallic free phthalocyanine particles and dispersing by means of a ball-mill, a coating material was prepared.

By applying this coating material onto the foregoing second photoconductive layer by the blade method, a 3μ-thick first photoconductive layer was formed.

This first photoconductive layer formed on the second photoconductive layer was cured by irradiating with electron beam under the following conditions while turing the support at a velocity of 6 rpm.

| | |
|---|---|
| voltage | 300 KV |
| electric current | 25 mA |
| distance between the source of radiation and the object to be irradiated | 25 cm |
| total amount of radiation | 6 M rad |
| atmosphere | air |

When measured by the same method as in Example 8, the photosensitive material prepared through the foregoing process manifested superior electrostatic properties such that Vs was +930 V and E ½ was 13 lux.sec. And, the first photoconductive layer constituting the surface of this photosensitive material had been cured enough to be invulnerable to such solvents as acetone, kerosene, etc., and the physical strength thereof such as resistance to abrasion, hardness, resistance to exfoliation, etc. was also satisfactory. When this photosensitive material was employed for copying by the use of a plain-paper copying machine according to the image-transferring method employing dry-developer, it displayed a durability sufficient for producing more than 10,000 copies while maintaining a satisfactory copied image with the background free of any stains.

REFERENCE EXAMPLE 1

By coating tetrahydrofuran solution of a composition consisting of poly-N-vinyl carbazole, 2,4,7-trinitro-9-fluorenone and polyester binder at the ratio of 4:6:0.8 (by weight) on a cylindrical aluminum support, 120 mm in outside diameter, 300 mm in length and 4 mm in thickness, to the extent of 14μ in dry thickness and drying thereafter, a photoconductive layer was prepared. Subsequently, the resin solution obtained in Example 1 was coated on this photoconductive layer to the extent of 1.5μ in thickness by the electrostatic coating method thereby forming an adhesive layer, and then a 2μ-thick light-transmissible film consisting of polyester was stuck on this adhesive layer. Next, while turning the support at a velocity of 6 rpm, the adhesive layer was cured by irradiating with electron beam under the following conditions, whereby an electrophotographic sensitive material was prepared.

| | |
|---|---|
| voltage | 300 KV |
| electric current | 10 mA |
| distance between the souece of radiation and the object to be irradiated | 25 cm |
| total amount of radiation | 7 M rad |
| atmosphere | air |

The photosensitive material prepared as above manifested satisfactory electrostatic properties such that the saturated electric potential Vs charged by corona discharge in the dark was −1220 V and the amount of exposure required for half-decay of said potential E ½ was 6.2 lux.sec. Also, the lighttransmissible film provided as the protective film had been firmly stuck to the photoconductive layer and was suprerior in physical strength such as frictional resistance, resistance to exfoliation, etc. And, when this photosensitive material was employed for copying by the use of a plain-paper copying machine according to Carlson's image forming method employing wetdeveloper (a copying machine equipped with mechanisms for charging of the photosensitive material, image-wise exposure, development of the image, transfer of the image to a plain paper, cleaning of developer left on the photosensitive material and elimination of charge from the photosensitive material), it could produce a satisfactory copied image with the background free of any stains and also displayed a durability sufficient for producing more than 30,000 copies. When the same test was repeated in both low-humidity atmosphere having a temperature of 20° C. and a RH of 20% and high-humidity atmosphere having a temperature of 30° C. and a RH of 90%, there was observed no impediment to the performance of the photosensitive material.

REFERENCE EXAMPLE 2

A solution was prepared by adding 40 g of N-vinyl pyrrolidone to 40 g of the same ionizing radiation-curable resin consisting of epoxide resin ester as employed in Example 1. Next, upon forming a photoconductive layer on a cylindrical aluminum support, 120 mm in diameter, 300 mm in length and 4 mm in thickness, by depositing selenium through vacuum evaporation to the extent of 50μ in thickness, by coating the foregoing solution by the roll method on said photoconductive layer to the extent of 1.5μ in thickness, a protection film was provided. Then by irradiating with electron beam under the following conditions while turning the support, said protective film was cured.

| | |
|---|---|
| voltage | 300 KV |
| electric current | 5 mA |
| distance between the source of radiation and the object to be irradiated | 25 cm |
| total amount of radiation | 12 M rad |
| atmosphere | nitrogen |

The photosensitive material prepared through the foregoing process manifested satisfactory electrostatic properties such that the saturated electric potential Vs charged by corona discharge in the dark was +970 V and the amount of exposure by means of tungsten lamp required for half-decay of said potential E ½ was 3.5 lux.sec. Also, the protective film thereof had been cured enough to be invulnerable to such solvents as acetone, kerosene, etc.

When this photosensitive material was employed for copying by the use of a plain-paper copying machine according to the image-transferring method employing wet-developer (a copying machine equipped with mechanism for charging of the photosensitive material, image-wise exposure, development of the image, transfer of the image to a plain paper, cleaning of developer left on the photosensitive material and elimination of charge from the photosenstive material), it could produce a satisfactory copied image with the background free of any stains and also displayed a durability sufficient for producing more than 10,000 copies. Further, when the same test was repeated in both low-humidity atmosphere having a temperature of 20° C. and a RH of 20% and high-humidity atmosphere having a temperature of 30° C. and a RH of 90%, there was observed no impediment to the performance of the photosensitive material.

On the other hand, when the same test was conducted of a comparative photosensitive material provided with a 1.5μ-thick protective film formed by coating polyvinyl butyral on the same photoconductive layer as that in the present reference example and drying thereafter by hot air having a temperature of 40° C. according to the conventional method, the durability of this photosensitive material was no more than sufficient for producing less than 7,000 copies, and the image obtained in the high-humidity atmosphere was blurred. Further, in the case where this comparative photosensitive material was prepared by drying by hot air having a temperature of 80° C. after coating polyvinyl butyral, there took place crystallization of selenium contained in the bottom layer thereof, and the electrostatic properties became quite inferior.

REFERENCE EXAMPLE 3

By adding 20 g of styrene as polymerizable monomer and 15 g of β-hydroxyethyl methacrylate to 30 g of the same urethanized fatty acid modified unsaturated polyester resin as employed in Example 2 and further adding thereto 1.5 g of benzoin methyl ether as photopolymerization initiator, a solventless photo-curing resin composition was prepared.

On the other hand, by depositing selenium to the extent of 60μ in thickness through vacuum evaporation on a cylindrical aluminum support, 120 mm in diameter, 300 mm in length and 4 mm in thickness, a photoconductive layer was formed.

Next, after forming an adhesive layer on this photoconductive layer by coating the foregoing composition thereon to the extent of 0.6μ in thickness by the spray method, a 2μ-thick light-transmissible film consisting of polyester was stuck on said adhesive layer. Subsequently, by curing the adhesive layer by applying the light of a 2 KW high-pressure mercury-arc lamp disposed at a distance of 30 cm for 150 seconds while turning the support at a velocity of 6 rpm, an electrophotographic sensitive material was prepared.

The photosensitive material thus prepared manifested satisfactory electrostatic properties such that the saturated electric potential Vs charged by corona discharge in the dark was +1320 V and the amount of exposure required for half-decay of said potential E ½ was 6.4 lux.sec, and the light-transmissible film had been well firmly stuck on the photoconductive layer. Also, when this photosensitive material was employed for copying by the use of a plain-paper copying machine equipped with the image-transferring mechanism employing dry-developer according to Carlson's method (a copying machine equipped with mechanisms for electrification of the photosensitive material, image-like exposure, development of the image, transfer of the image to a plain-paper, cleaning of developer left on the photosensitive material and elimination of electricity from the photosensitive material), it could produce a satisfactory copied image with the background free of any stains and also displayed a durability sufficient for producing more than 30,000 copies.

Further, when the same test was repeated in both low-humidity atmosphere having a temperature of 20° C. and a RH of 20% and high-humidity atmosphere having a temperature of 30° C. and a RH of 90%, there was observed no impediment to the formation of image.

REFERENCE EXAMPLE 4

By adding 2 g of benzoin as photo-polymerization initiator, 20 g of N-vinyl pyrrolidone as polymerizable monomer and 20 g of acetone as diluent to 40 g of the same epoxide resin ester as employed in Example 1, a solution of ultraviolet-rays-curing resin composition was prepared.

Next, after forming a photoconductive layer on a cylindrical aluminum support, 120 mm in diameter, 300 mm in length and 4 mm in thickness, by depositing selenium to the extent of 50μ in thickness through vacuum evaporation, a protective film was provided on said photoconductive layer by applying the foregoing solution by the electrostatic coating method to the extent of 1.5μ in thickness after volatilization of diluent. Subsequently, by irradiating with ultraviolet rays under the following conditions while turning the support at a velocity of 6 rpm, said protective film was cured.

| | |
|---|---|
| source of light | 2 KV high pressure mercury-arc lamp |
| distance between the source of light and the object to be irradiated | 25 cm |
| time of irradiation | 30 seconds |
| atmosphere | nitrogen |

The electrophotographic sensitive material prepared through the foregoing process manifested satisfactory electrostatic properties such that the saturated electric potential Vs charged by corona discharge in the dark was +1180 V and the amount of exposure by means of tungsten lamp required for half-decay of said potential E ½ was 4.6 lux.sec. Also, the protective film had been cured enough to be invulnerable to such solvents as acetone, kerosene, etc.

And, when this photosensitive material was employed for copying by the use a plain-paper copying machine according to the image-transferring method employing wet-developer (a copying machine equipped with mechanisms for charging of the photosensitive material, image-like exposure, development of the image, transfer of the image to a plain paper, cleaning of developer left on the photosensitive material and elimination of charge from the photosensitive material), it could produce a satisfactory copied image with the background free of any stains and also displayed a durability sufficient for producing more than 10,000 copies. Further, when the same test was repeated in both low-humidity atmosphere having a temperature of 20° C. and a RH of 20% and high-humidity atmosphere hving a temperature of 30° C. and a RH of 90%, there was observed no impediment to the formation of image.

On the other hand, when the same test was conducted of a comparative photosensitive material provided with a 1.5μ-thick protective film which was formed by coating polyvinyl butyral on the same photoconductive layer as that in the present reference example and drying thereafter by a warm wind having a temperature of 40° C. according to the conventional method, the durability of this photosensitive material was no more than sufficient for producing less than 7,000 copies, and the image obtained in the high-humidity atmosphere was blurred. Further, in the case where this comparative photosensitive material was prepared by drying by a hot wind having a temperature of 80° C. after coating polyvinyl butyral, there took place crystallization of selenium contained in the bottom layer thereof, and the electrostatic properties became simply inferior.

REFERENCE EXAMPLE 5

After forming a photoconductive layer on a cylindrical aluminum support, 120 mm in diameter, 300 mm in length and 4 mm in thickness, by depositing selenium to the extent of 50μ in thickness through vacuum evaporation, a protective film was provided on said photoconductive layer by applying a composition consisting essentially of polyvinyl cinnamate (namely, KPR, the manufacture of Eastman Kodak Co., U.S.A.) thereon to the extent of 1.5μ in dry thickness. Subsequently, by applying radiation under the following conditions while turning the support at a velocity of 6 rpm, said protective film was cured.

| | |
|---|---|
| source of radiation | 500 W high-tension mercury arc-lamp |
| distance between the source of radiation and the object to be irradiated | 10 cm |
| time of irradiation | 60 seconds |
| atmosphere | nitrogen |

The electrophotographic sensitive material prepared through the foregoing process manifested satisfactory electrostatic properties such that the saturated electric potential Vs charged by corona discharge in the dark was +980 V and the amount of exposure by means of tungsten lamp required for half-decay of said potential E ½ was 3.7 lux.sec. Also, the protective film had been cured enough to be invulnerable to such solvents as isoparaffin type hydrocarbon, etc.

And, when this photosensitive material was employed for copying by the use of a plain-paper copying machine according to the image-transferring method employing wet-developer (a copying machine equipped with mechanisms for charging of the photosensitive material, image-like exposure, development of the image, transfer of the image to a plain paper, cleaning of developer left on the photosensitive material and elimination of charge from the photosensitive material), it could produce a satisfactory copied image with the background free of any stains and also displayed a durability sufficient for producing more than 10,000 copies. Further, when the same test was repeated in both low-humidity atmosphere having a temperature of 20° C. and a RH of 20% and high-humidity atmosphere having a temperature of 30° C. and a RH of 90° C., there was observed no impediment to the formation of image.

On the other hand, when the same test was conducted of a comparative photosensitive material provided with a 1.5μ-thick protective film formed by coating polyvinyl butyral on the same photoconductive layer as that in the present reference example and drying thereafter by a warm wind having a temperature of 40° C. according to the conventional method, the durability of this photosensitive material was no more than sufficient for producing less than 7,000 copies, and the image obtained in the high-humidity atmosphere was blurred. Further, in the case where this comparative photosensitive material was prepared by drying by a hot wind having a temperature of 80° C. after coating polyvinyl butyral, there took place crystallization of selenium contained in the bottom layer thereof, and the electrostatic properties became simply inferior.

REFERENCE EXAMPLE 6

An acrylate sensitive liquid type photoresist material was prepared by admixing 1,200 g of terpolymer consisting of methyl methacrylate, acryonitrile and acrylated glycidyl acrylic ester at the ratio of 65:10:25 (by weight), 600 g of copolymer consisting of methyl methacrylate and acrylic acid-β-hydroxyethyl at the ratio of 90:10 (by weight), 140 g of tertiary butyl anthraquinone and 10,000 g of methyl ethyl ketone.

Next, after forming a photoconductive layer on a cylindrical aluminum support, 120 mm in diameter, 300 mm in length and 4 mm in thickness, by depositing selenium to the extent of 50μ in thickness through vacuum evaporation, a protective film was provided on said photoconductive layer by applying the foregoing acrylate sensitive liquid thereon to the extent of 1.5μ in thickness after volatilization of solvent. Subsequently, by irradiating intrinsic absorption light under the following conditions while turning the support at a velocity of 6 rpm, said protective film was cured.

| | |
|---|---|
| source of light | 2 KW high pressure mercury arc lamp |
| distance between the source of light and the object to be irradiated with light | 25 cm |
| time of irradiation | 120 seconds |
| atmosphere | nitrogen |

The electrophotographic sensitive material prepared through the foregoing process manifested satisfactory electrostatic properties such that the saturated electric potential Vs charged by corona discharge in the dark was +970 V and the amount of exposure by means of tungsten lamp required for half-decay of said potential E ½ was 3.5 lux.sec. Also, the protective film had been cured enough to be invulnerable to such solvents as acetone, kerosene, etc.

And, when this photosensitive material was employed for copying by the use of a plain-paper copying machine, according to the image-transferring method employing wet-developer (a copying machine equipped with mechanisms for charging of the photosensitive material, image-like exposure, development of the image, transfer of the image to a plain paper, cleaning of developer left on the photosensitive material and elimination of charge from the photosensitive material), it could produce a satisfactory copied image with the background free of any stains and also displayed a durability sufficient for producing more than 10,000 copies. Further, when the same test was repeated in both low-humidity atmosphere having a temperature of 20° C. and a RH of 20% and high-humidity atmosphere having a temperature of 30° C. and a RH of 90%, there was observed no impediment to the formation of image.

On the other hand, when the same test was conducted of a comparative photosensitive material provided with a 1.5μ-thick protective film formed by coating polyvinyl butyral on the same photoconductive layer as that in the present reference example and drying thereafter by a warm wind having a temperature of 40° C. according to the conventional method, the durability of this photosensitive material was no more than sufficient for producing less than 7,000 copies, and the image obtained in the high-humidity atmosphere was blurred. Further, in the case where this comparative photosensitive material was prepared by drying by a hot wind having a temperature of 80° C. after coating polyvinyl butyral, there took place crystallization of selenium contained in the bottom layer thereof, and the electrostatic properties became simply inferior.

What is claimed is:

1. An electrophotographic plate, comprising:

an electrically conductive substrate;

a first photoconductive layer coated over said substrate and having a thickness of from 0.1μ to 10μ, said first photoconductive layer consisting essentially of a mixture of an inorganic or organic first photoconductor and a resin that has been cured by ionizing radiation, said first photoconductive layer having been prepared by applying onto said substrate a liquid dispersion or solution of said first photoconductor and from 0.2 to 50 percent by weight, based on the weight of said first photoconductor, of a radiation-curable resin selected from the group consisting of non-modified maleic anhydride-type unsaturated polyester, silicone-modified, urethane-modified or acrylic urethane-modified maleic anhydride-type unsaturated polyester, polyester having maleyl group therein, acrylic polymer having maleyl group therein, epoxide resin having maleyl group therein, acrylic polymer having acryloyl group as a side chain thereof, telomerized polyester acrylate, telomerized polyamide acrylate, epoxyacrylate, urethane acrylate, silicone acrylate, and reactive allyl group-containing resin, and then applying ionizing radiation to said first photoconductive layer, in a solvent-free state, until said radiation-curable resin has been cured; and a second photoconductive layer coated over said first photoconductive layer and having a thickness of from 3μ to 50μ, said second photoconductive layer consisting essentially of an organic second photoconductor and a resin binder therefor, said second photoconductive layer having been prepared by applying a liquid dispersion or solution of said organic second photoconductor and said resin binder in an organic solvent onto said first photoconductive layer having said cured resin therein and then evaporating the solvent.

2. An electrophotographic plate as claimed in claim 1 in which the thickness of said first photoconductive layer is from 0.5 to 3μ, and the thickness of said second photoconductive layer is from 6 to 20μ.

3. An electrophotographic plate as claimed in claim 1 in which said dispersion or solution applied for forming said first photoconductive layer also contains mixed therein at least one polymerizable monomer selected from the group consisting of styrene, methyl methacrylate, ethyl methacrylate, butyl methacrylate, dimethylaminoethyl methacrylate, tetrahydrofurfuryl methacrylate, butyl acrylate, 2-ethylhexyl acrylate and N-vinyl pyrrolidone, said first photoconductive layer consisting essentially of said first photoconductor and the reaction product obtained by applying ionizing radiation to the mixture of said radiation-curable resin and said monomer.

4. An electrophotographic plate, comprising:

an electrically conductive substrate;

a first photoconductive layer coated over said substrate and having a thickness of from 3μ to 50μ, said first photoconductive layer consisting essentially of an organic first photoconductor and a resin binder therefor; and a second photoconductive layer coated over said first photoconductive layer and having a thickness of from 0.1μ to 10μ, said second photoconductive layer consisting essentially of a mixture of an inorganic or organic second photoconductor and a resin that has been cured by ionizing radiation, said second photoconductive layer having been prepared by applying onto said first photoconductive layer a liquid dispersion or solution of said second photoconductor and from 0.2 to 50 percent by weight, based on the weight of said second photoconductor, of a radiation-curable resin selected from the group consisting of non-modified maleic anhydride-type unsaturated polyester, silicone-modified, urethane-modified or acrylic urethane-modified maleic anhydride-type unsaturated polyester, polyester having maleyl group therein, acrylic polymer having maleyl group therein, epoxide resin having maleyl group therein, acrylic polymer having acryloyl group as a side chain thereof, telomerized polyester acrylate, telomerized polyamide acrylate, epoxyacrylate, urethane acrylate, silicone acrylate, and reactive allyl group-containing resin and then applying ionizing radiation to said second photoconductive layer, in a solvent-free state, until said radiation-curable resin is cured.

5. An electrophotographic plate as claimed in claim 4 in which the thickness of said second photoconductive layer is from 0.5 to 3μ, and the thickness of said first photoconductive layer is from 6 to 20μ.

6. An electrophotographic plate as claimed in claim 4 in which said dispersion or solution applied for forming said second photoconductive layer also contains mixed therein at least one polymerizable monomer selected from the group consisting of styrene, methyl methacrylate, ethyl methacrylate, butyl methacrylate, dimethylaminoethyl methacrylate, tetrahydrofurfuryl methacrylate, butyl acrylate, 2-ethylhexyl acrylate and N-vinyl pyrrolidone, said second photoconductive layer consisting essentially of said second photoconductor and the reaction product obtained by applying ionizing radiation to the mixture of said radiation-curable resin and said monomer.

7. An electrophotographic plate, comprising:
an electrically conductive substrate; and
a photoconductive layer coated over said substrate and having a thickness of from 3 to 80μ, said photoconductive layer consisting essentially of a mixture of an inorganic or organic photoconductor and a resin that has been cured by ionizing radiation, said photoconductive layer having been prepared by applying onto said substrate a liquid dispersion or solution of said photoconductor and from 0.2 to 50 percent by weight, based on the weight of said photoconductor, of a radiation-curable resin selected from the group consisting of non-modified maleic anhydride-type unsaturated polyester, silicone-modified, urethane-modified or acrylic urethane-modified maleic anhydride-type unsaturated polyester, polyester having maleyl group therein, acrylic polymer having maleyl group therein, epoxide resin having maleyl group therein, acrylic polymer having acryloyl group as a side chain thereof, telomerized polyester acrylate, telomerized polyamide acrylate, epoxyacrylate, urethane acrylate, silicone acrylate, and reactive allyl group-containing resin, and then applying ionizing radiation to said photoconductive layer, in a solvent-free state, until said radiation-curable resin has been cured.

8. An electrophotographic plate as claimed in claim 7 in which said dispersion or solution applied for forming said photoconductive layer also contains mixed therein at least one polymerizable monomer selected from the group consisting of styrene, methyl methacrylate, ethyl methacrylate, butyl methacrylate, dimethylaminoethyl methacrylate, tetrahydrofurfuryl methacrylate, butyl acrylate, 2-ethylhexyl acrylate and N-vinyl pyrrolidone, said layer consisting essentially of said photoconductor and the reaction product obtained by applying ionizing radiation to the mixture of said radiation-curable resin and said monomer.

9. An electrophotographic plate according to claim 7 in which said ionizing radiation is selected from the group consisting of accelerated electron beam, neutrons, α-rays, β-rays, γ-rays, X-rays, protons and deuterons.

10. An electrophotographic plate according to claim 9 in which said radiation-curable resin is selected from the group consisting of epoxide resin fumaric acid ester, urethanized fatty acid-modified unsaturated polyester resin, fatty acid modified saturated polyester resin, silicone modified maleic anhydride unsaturated polyester resin, copolymer of glycidyl methacrylate and methyl methacrylate mixed with propiolic acid and the reaction product of a copolymer of methyl methalcrylate and allyl glycidyl ether with allyl alcohol.

11. An electrophotographic plate according to claim 1 in which said ionizing radiation is selected from the group consisting of accelerated electron beam, neutrons, α-rays, β-rays, γ-rays, X-rays, protons and deuterons.

12. An electrophotographic plate according to claim 11 in which said resin is selected from the group consisting of epoxide resin fumaric acid ester, urethanized fatty acid-modified unsaturated polyester resin, fatty acid modified saturated polyester resin, silicone modified maleic anhydride unsaturated polyester resin, copolymer of glycidyl methacrylate and methyl methacrylate mixed with propiolic acid and the reaction product of a copolymer of methyl methacrylate and allyl glycidyl ether with allyl alcohol.

13. An electrophotographic plate according to claim 4 in which said ionizing radiation is selected from the group consisting of accelerated electron beam, neutrons, α-rays, β-rays, γ-rays, X-rays, protons and deuterons.

14. An electrophotographic plate according to claim 13 in which said resin is selected from the group consisting of epoxide resin fumaric acid ester, urethanized fatty acid-modified unsaturated polyester resin, fatty acid modified saturated polyester resin, silicone modified maleic anhydride unsaturated polyester resin, copolymer of glycidyl methacrylate and methyl methacrylate mixed with propiolic acid and the reaction product of a copolymer of methyl methacrylate and allyl glycidyl ether with allyl alcohol.

* * * * *